US007923185B2

(12) United States Patent
Wu et al.

(10) Patent No.: US 7,923,185 B2
(45) Date of Patent: Apr. 12, 2011

(54) PYRAZINE CONTAINING CHARGE TRANSPORT LAYER PHOTOCONDUCTORS

(75) Inventors: Jin Wu, Webster, NY (US); Terry L Street, Fairport, NY (US); Terry L Bluhm, Pittsford, NY (US); Kent J Evans, Lima, NY (US); Edward F Grabowski, Webster, NY (US); Susan M Vandusen, Williamson, NY (US); Min-Hong Fu, Webster, NY (US); Kathleen M Carmichael, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 482 days.

(21) Appl. No.: 12/112,330

(22) Filed: Apr. 30, 2008

(65) Prior Publication Data

US 2009/0274968 A1 Nov. 5, 2009

(51) Int. Cl.
*G03G 5/047* (2006.01)

(52) U.S. Cl. ..... 430/58.5; 430/970

(58) Field of Classification Search ..... 430/58.5, 430/59.4, 59.5, 970, 59.1
See application file for complete search history.

(56) References Cited

U.S. PATENT DOCUMENTS

| | | | | |
|---|---|---|---|---|
| 4,265,990 | A | | 5/1981 | Stolka et al. |
| 4,587,189 | A | | 5/1986 | Hor et al. |
| 5,393,628 | A | * | 2/1995 | Ikezue et al. ..... 430/58.5 |
| 5,473,064 | A | | 12/1995 | Mayo et al. |
| 5,482,811 | A | | 1/1996 | Keoshkerian et al. |
| 5,521,306 | A | | 5/1996 | Burt et al. |
| 6,913,863 | B2 | | 7/2005 | Wu et al. |
| 7,662,526 | B2 | | 2/2010 | Lin et al. |
| 7,687,212 | B2 | | 3/2010 | Wu |
| 7,709,168 | B2 | | 5/2010 | Wu et al. |
| 7,709,169 | B2 | | 5/2010 | Wu |
| 2008/0274419 | A1 | | 11/2008 | Lin et al. |
| 2009/0092910 | A1 | | 4/2009 | Wu |
| 2009/0092911 | A1 | | 4/2009 | Wu et al. |
| 2009/0092912 | A1 | | 4/2009 | Wu et al. |
| 2009/0092913 | A1 | | 4/2009 | Wu et al. |
| 2009/0092914 | A1 | | 4/2009 | Wu et al. |
| 2009/0274965 | A1 | | 11/2009 | Wu et al. |
| 2009/0274966 | A1 | | 11/2009 | Wu |
| 2009/0274967 | A1 | | 11/2009 | Wu et al. |
| 2009/0274969 | A1 | | 11/2009 | Wu |
| 2009/0274970 | A1 | | 11/2009 | Wu et al. |
| 2009/0274971 | A1 | | 11/2009 | Wu |

FOREIGN PATENT DOCUMENTS

| | | | | |
|---|---|---|---|---|
| JP | 62201446 | A | * | 9/1987 |
| JP | 02176665 | A | * | 7/1990 |
| JP | 02285358 | A | * | 11/1990 |
| JP | 03048853 | A | * | 3/1991 |
| JP | 03103859 | A | * | 4/1991 |
| JP | 05088388 | A | * | 4/1993 |
| JP | 07152172 | A | * | 6/1995 |
| JP | 10142819 | A | * | 5/1998 |

OTHER PUBLICATIONS

English language machine translation of JP 10-142819 (May 1998).*
English language machine translation of JP 07-152172 (Jun. 1995).*
English language machine translation of JP 05-088388 (Apr. 1993).*
Jin Wu et al., U.S. Appl. No. 11/869,231 on Additive Containing Photogenerating Layer Photoconductors, filed Oct. 9, 2007.
Jin Wu et al., U.S. Appl. No. 11/869,246 on Phosphonium Containing Photogenerating Layer Photoconductors, filed Oct. 9, 2007.
Jin Wu et al., U.S. Appl. No. 11/869,252 on Additive Containing Charge Transport Layer Photoconductors, filed Oct. 9, 2007.
Jin Wu et al., U.S. Appl. No. 11/869,258 on Imidazolium Salt Containing Charge Transport Layer Photoconductors, filed Oct. 9, 2007.
Jin Wu et al., U.S. Appl. No. 11/869,265 on Phosphonium Containing Charge Transport Layer Photoconductors, filed Oct. 9, 2007.
Jin Wu et al., U.S. Appl. No. 11/869,269 on Charge Trapping Releaser Containing Charge Transport Layer Photoconductors, filed Oct. 9, 2007.
Jin Wu et al., U.S. Appl. No. 11/869,279 on Charge Trapping Releaser Containing Photogenerating Layer Photoconductors, filed Oct. 9, 2007.
Jin Wu, U.S. Appl. No. 11/869,284 on Salt Additive Containing Photoconductors, Filed Oct. 9, 2007.
Liang-Bih Lin et al., U.S. Appl. No. 11/800,108 on Photoconductors, filed May 4, 2007.
Liang-Bih Lin et al., U.S. Appl. No. 11/800,129 on Photoconductors, filed May 4, 2007.

* cited by examiner

*Primary Examiner* — Christopher RoDee
(74) *Attorney, Agent, or Firm* — Oliff & Berridge, PLC

(57) ABSTRACT

A photoconductor that includes, for example, a supporting substrate, a photogenerating layer, and at least one charge transport layer comprised of at least one charge transport component, and wherein the charge transport layer contains a pyrazine.

25 Claims, No Drawings

PYRAZINE CONTAINING CHARGE TRANSPORT LAYER PHOTOCONDUCTORS

CROSS REFERENCE TO RELATED APPLICATIONS

Copending U.S. application Ser. No. 12/112,206, U.S. Publication No. 20090274965 on Metal Mercaptoimidazoles Containing Photoconductors, filed Apr. 30, 2008, the disclosure of which is totally incorporated herein by reference.

Copending U.S. application Ser. No. 12/112,282, U.S. Publication No. 20090274971 on Thiophthalimides Containing Photoconductors, filed Apr. 30, 2008, the disclosure of which is totally incorporated herein by reference.

Copending U.S. application Ser. No. 12/112,294, U.S. Publication No. 20090274966 on Phenazine Containing Photoconductors, filed Apr. 30, 2008, the disclosure of which is totally incorporated herein by reference.

Copending U.S. application Ser. No. 12/112,308, U.S. Patent Publication 20090274967 on Quinoxaline Containing Photoconductors, filed Apr. 30, 2008, the disclosure of which is totally incorporated herein by reference.

Copending U.S. application Ser. No. 12/112,322, U.S. Publication No. 20090274970 on Carbazole Containing Charge Transport Layer Photoconductors, filed Apr. 30, 2008, the disclosure of which is totally incorporated herein by reference.

Copending U.S. application Ser. No. 12/112,338, U.S. Publication No. 20090274969 on Phenothiazine Containing Photogenerating Layer Photoconductors, filed Apr. 30, 2008, the disclosure of which is totally incorporated herein by reference.

U.S. application Ser. No. 11/869,231, U.S. Publication No. 20090092913, filed Oct. 9, 2007, entitled Additive Containing Photogenerating Layer Photoconductors, the disclosure of which is totally incorporated herein by reference, illustrates a photoconductor comprising a supporting substrate, a photogenerating layer, and at least one charge transport layer comprised of at least one charge transport component, and wherein the photogenerating layer contains at least one of an ammonium salt and an imidazolium salt.

U.S. application Ser. No. 11/869,246, U.S. Publication No. 20090092914, filed Oct. 9, 2007, entitled Phosphonium Containing Photogenerating Layer Photoconductors, the disclosure of which is totally incorporated herein by reference, illustrates a photoconductor comprising a supporting substrate, a phosphonium salt containing photogenerating layer, and at least one charge transport layer comprised of at least one charge transport component.

U.S. application Ser. No. 11/869,252, U.S. Publication No. 20090092911, filed Oct. 9, 2007, entitled Additive Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein the charge transport layer contains at least one ammonium salt.

U.S. application Ser. No. 11/869,258, U.S. Publication No. 20090092912, filed Oct. 9, 2007, entitled Imidazolium Salt Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein at least one charge transport layer contains at least one imidazolium salt.

U.S. application Ser. No. 11/869,265, now U.S. Pat. No. 7,709,168, filed Oct. 9, 2007, entitled Phosphonium Containing Charge Transport Layer Photoconductors, the disclosure of which is totally incorporated herein by reference, there is disclosed a photoconductor comprising a supporting substrate, a photogenerating layer, and at least one charge transport layer comprised of at least one charge transport component, and wherein the at least one charge transport layer contains at least one phosphonium salt.

U.S. application Ser. No. 11/869,269, now U.S. Pat. No. 7,709,169, filed Oct. 9, 2007, entitled Charge Trapping Releaser Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein the at least one charge transport layer contains at least one charge trapping releaser.

U.S. application Ser. No. 11/869,279, now U.S. Pat. No. 7,687,212, filed Oct. 9, 2007, entitled Charge Trapping Releaser Containing Photogenerating Layer Photoconductors, the disclosure of which is totally incorporated herein by reference, there is disclosed a photoconductor comprising a supporting substrate, a photogenerating layer, and at least one charge transport layer comprised of at least one charge transport component, and wherein the photogenerating layer contains at least one charge trapping releaser component.

U.S. application Ser. No. 11/869,284, U.S. Publication No. 20090092910, filed Oct. 9, 2007, entitled Salt Additive Containing Photoconductors, the disclosure of which is totally incorporated herein by reference, illustrates a photoconductor comprising a supporting substrate, a photogenerating layer, and at least one charge transport layer comprised of at least one charge transport component, and wherein at least one of the photogenerating layer and the charge transport layer contains at least one of a pyridinium salt and a tetrazolium salt.

In U.S. application Ser. No. 11/800,129, U.S. Publication No. 20080274419, entitled Photoconductors, filed May 4, 2007, the disclosure of which is totally incorporated herein by reference, there is illustrated a photoconductor comprising a supporting substrate, a photogenerating layer, and at least one charge transport layer comprised of at least one charge transport component, and wherein the photogenerating layer contains a bis(pyridyl)alkylene.

In U.S. application Ser. No. 11/800,108, now U.S. Pat. No. 7,662,526, entitled Photoconductors, filed May 4, 2007, the disclosure of which is totally incorporated herein by reference, there is illustrated a photoconductor comprising a supporting substrate, a photogenerating layer, and at least one charge transport layer comprised of at least one charge transport component, and wherein the charge transport layer contains a benzoimidazole.

BACKGROUND

This disclosure is generally directed to imaging members, photoreceptors, photoconductors, and the like. More specifically, the present disclosure is directed to drum, multilayered drum, or flexible, belt imaging members, or devices comprised of a supporting medium like a substrate, a photogenerating layer, and a charge transport layer, including a plurality of charge transport layers, such as a first charge transport layer and a second charge transport layer, and wherein one or more of the charge transport layers contains as an additive or dopant a pyrazine, and a photoconductor comprised of a supporting medium like a substrate, a photogenerating layer, and a charge transport layer which contains an additive or dopant of a pyrazine, and more specifically, a first charge transport layer and a second charge transport layer, and where the charge transport layer includes a pyrazine component that results in photoconductors with a number of advantages, such as in embodiments, desirable light shock reductions; the minimization or substantial elimination of undesirable ghosting on developed images, such as xerographic images, including improved ghosting at various relative humidities; excellent cyclic and stable electrical properties; minimal charge deficient spots (CDS); compatibility with the photogenerating and charge transport resin binders; and acceptable lateral charge migration (LCM) characteristics, such as for example, excellent LCM resistance. At least one in embodiments refers, for example, to one, to from 1 to about 10, to from 2 to about 6; to from 2 to about 4; 2, and the like.

Light shock or light fatigue of photoconductors usually causes dark bands in the resulting xerographic prints caused by the light exposed photoconductor area at time zero, while the photoconductors disclosed herein in embodiments minimize or avoid this disadvantage in that, for example, the light shock resistant photoconductors do not usually print undesirable dark bands even when the photoconductor is exposed to light like office light sources. More specifically, light shock can be caused by the solvent selected for the charge transport layer dispersion, for example, a carbon tetrachloride containing methylene chloride, that is for example, the light shock may in embodiments be caused by carbon tetrachloride or similar contaminated components present in the charge transport layer dispersion, such as methylene chloride. Accordingly, for example, when the charge transport layer coating solvent of methylene chloride contains about 200 parts per million of carbon tetrachloride the light shock value is increased from 1 percent, with no carbon tetrachloride, to 30 percent. This compares to a light shock reduction to, for example, 3 percent when a pyrazine, as illustrated herein, is included in the charge transport layer coating solution.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure.

The photoconductors disclosed herein are in embodiments sensitive in the wavelength region of, for example, from about 400 to about 900 nanometers, and in particular from about 650 to about 850 nanometers, thus diode lasers can be selected as the light source. Moreover, the photoconductors disclosed herein are in embodiments useful in high resolution color xerographic applications, particularly high-speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically, about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

The appropriate components, such as the supporting substrates, the photogenerating layer components, the charge transport layer components, the overcoating layer components, and the like of the above-recited patents, may be selected for the photoconductors of the present disclosure in embodiments thereof.

SUMMARY

Disclosed are imaging members and photoconductors that contain a dopant in the charge transport layer, and where there are permitted preselected electrical characteristics, and more specifically, excellent light shock resistance, acceptable photoinduced discharge (PIDC) values, excellent lateral charge migration (LCM) resistance, and excellent cyclic stability properties.

Additionally disclosed are flexible belt imaging members containing optional hole blocking layers comprised of, for example, amino silanes (throughout in this disclosure plural also includes nonplural, thus there can be selected a single amino silane), metal oxides, phenolic resins, and optional phenolic compounds, and which phenolic compounds contain at least two, and more specifically, two to ten phenol groups or phenolic resins with, for example, a weight average molecular weight of from about 500 to about 3,000, permitting, for example, a hole blocking layer with excellent efficient electron transport which usually results in a desirable photoconductor low residual potential $V_{low}$.

The photoconductors illustrated herein, in embodiments, have low acceptable image ghosting characteristics; low background and/or minimal charge deficient spots (CDS); and desirable toner cleanability. At least one in embodiments refers, for example, to one, to from 1 to about 10, to from 2 to about 7; to from 2 to about 4, to two, and the like.

EMBODIMENTS

Aspects of the present disclosure relate to a photoconductor comprising a supporting substrate, a photogenerating layer, and at least one charge transport layer comprised of at least one charge transport component, and where a charge transport layer contains the additive or dopant as illustrated herein; a photoconductor comprising a supporting substrate, a photogenerating layer, and a charge transport layer comprised of at least one charge transport component, and a pyrazine; a photoconductor comprised in sequence of an optional supporting substrate, a hole blocking layer, an adhesive layer, a photogenerating layer, and a pyrazine charge transport layer; a photoconductor wherein the charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof; and wherein the at least one charge transport layer is from 1 to about 4; a photoconductor wherein the photogenerating pigment is a hydroxygallium phthalocyanine, a titanyl phthalocyanine, a halogallium phthalocyanine or a perylene; a photoconductor wherein at least one charge transport layer is comprised of a first charge transport layer, and a second charge transport layer, and wherein the pyrazine additive is included in one charge transport layer, or in each charge transport layer in an amount of, for example, from about 0.001 to about 25, 0.005 to about 10, 0.01 to about 1 weight percent; a photoconductor wherein the substrate is comprised of a conductive material, and a flexible photoconductive imaging member comprised in sequence of a supporting substrate, photogenerating layer thereover, a pyrazine containing charge transport layer, and a protective top overcoat layer; a photoconductor which includes a hole blocking layer and an adhesive layer where the adhesive layer is situated between the hole blocking layer and the photogenerating layer, and the hole blocking layer is situated between the substrate and the adhesive layer; and a photoconductor wherein the additive or dopant can be selected in various effective amounts, such as for example, from about 0.005 to about 10, 0.01 to about 1 weight percent of the additive.

ADDITIVE/DOPANT EXAMPLES

Examples of the additive or dopant, which can function as a light shock reducing agent present, for example, in various amounts, such as from 0.005 to about 10, 0.01 to about 1 weight percent, include, for example, a number of known suitable components, such as pyrazines.

In embodiments, examples of pyrazines included in the charge transport layer can be represented by the following structure/formula

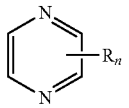

wherein n represents the number of R substituents, and more specifically, where R is hydrogen, suitable substituting groups or mixtures thereof with, for example, from 1 to about 42 carbon atoms. Examples of R groups include alkyl with, for example, from 1 to about 18 carbon atoms, such as methyl, ethyl, n-propyl, isopropyl, isobutyl, n-butyl; aryl such as phenyl; alkoxy with, for example, from 1 to about 18 carbon atoms, such as methoxy, ethoxy, isopropoxy; halo such as fluoro, iodo, chloro, bromo; mercapto such as mercaptoethyl; thio such as methylthio, furfurylthio; amino; acetyl; carboxyamide; pyridyl; cyano, and the like.

Specific examples of pyrazines are 2,3,5,6-tetramethylpyrazine, pyrazine, (2-mercaptoethyl)pyrazine, 2,3,5-trimethylpyrazine, 2,3-dichloropyrazine, 2,3-dicyano-5-methylpyrazine, 2,3-diethyl-5-methylpyrazine, 2-(methylthio) pyrazine, 2-acetyl-3-ethylpyrazine, 2-amino-3,5-dibromopyrazine, 2-amino-5-phenylpyrazine, 2-furfurylthio-3-methylpyrazine, 5-methyl-2,3-cyclopenteopyrazine, pyrazinecarboxamide, 2,3-di-2-pyridylpyrazine, 2,3-dimethylpyrido(2,3-b)pyrazine, and 6-methyl-7-phenyl-5H-pyrrolo[2,3-b]pyrazine.

In embodiments, the pyrazines selected for the disclosed photoconductors are represented by at least one of

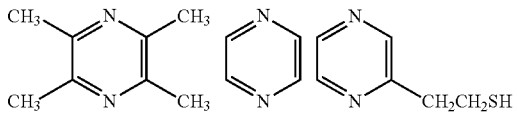

-continued

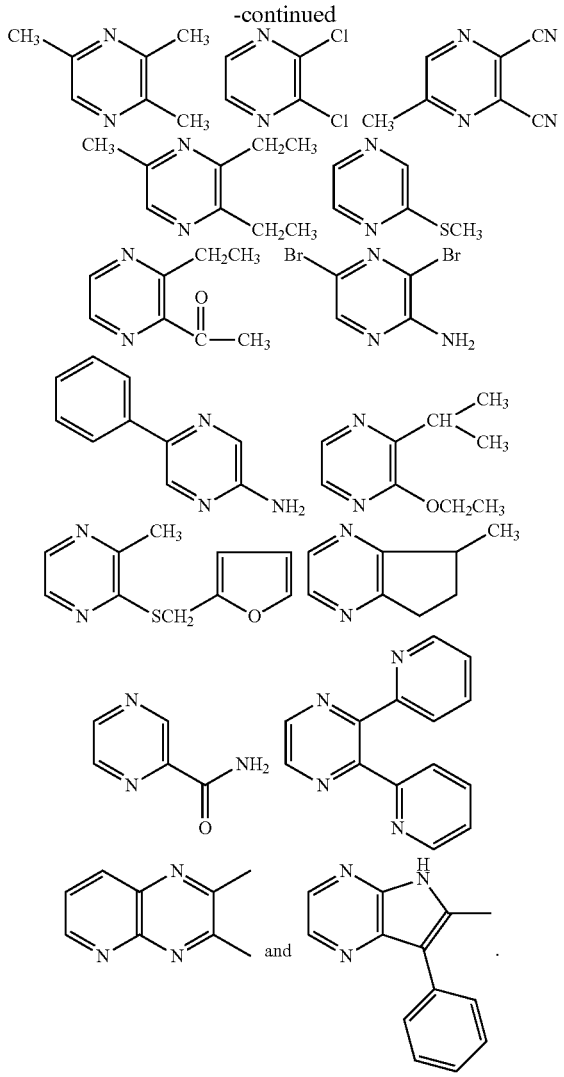

Photoconductive Layer Components

There can be selected for the photoconductors disclosed herein a number of known layers, such as substrates, photogenerating layers, charge transport layers (CTL), hole blocking layers, adhesive layers, protective overcoat layers, and the like. Examples, thicknesses, specific components of many of these layers include the following.

The thickness of the photoconductor substrate layer depends on various factors, including economical considerations, desired electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 microns to about 300 microns, or from about 100 to about 150 microns. In embodiments, the photoconductor can be free of a substrate, for example the layer usually in contact with the substrate can be increased in thickness. For a photoconductor drum, the substrate or supporting medium may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

Also, the photoconductor may in embodiments include a blocking layer, an adhesive layer, a top overcoating protective layer, and an anticurl backing layer.

The photoconductor substrate may be opaque, substantially opaque, or substantially transparent, and may comprise any suitable material that, for example, permits the photoconductor layers to be supported. Accordingly, the substrate may comprise a number of known layers, and more specifically, the substrate can be comprised of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may comprise any suitable metal of, for example, aluminum, nickel, steel, copper, and the like, or a polymeric material filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer is to be rendered conductive, the surface thereof may be rendered electrically conductive by an electrically conductive coating. The conductive coating may vary in thickness depending upon the optical transparency, degree of flexibility desired, and economic factors, and in embodiments this layer can be of a thickness of from about 0.05 micron to about 5 microns.

Illustrative examples of substrates are as illustrated herein, and more specifically, supporting substrate layers selected for the photoconductors of the present disclosure comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, and more specifically, alkylhydroxyl gallium phthalocyanines, hydroxygallium phthalocyanines, chlorogallium phthalocyanines, perylenes, especially bis(benzimidazo)perylene, titanyl phthalocyanines, and the like, and yet more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume.

In embodiments, the photogenerating component or pigment is present in a resinous binder in various amounts, inclusive of 100 percent by weight based on the weight of the photogenerating components that are present. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, examples of polymeric binder materials that can be selected as the matrix for the photogenerating layer components are known and include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly (amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The optional hole blocking or undercoat layer or layers selected for the photoconductors of the present disclosure can contain a number of components including known hole blocking components, such as amino silanes, doped metal oxides, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 15 microns to about 40 microns. Examples of charge transport components are aryl amines of the following formulas/structures

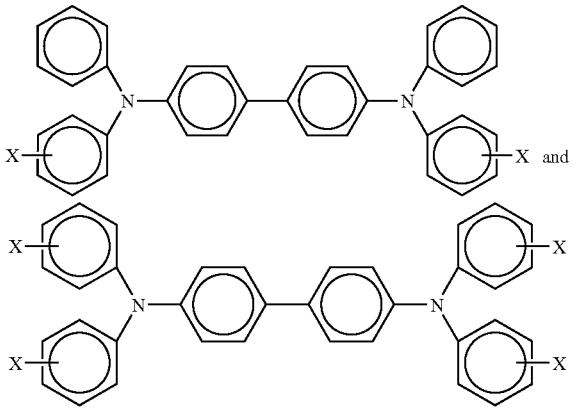

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

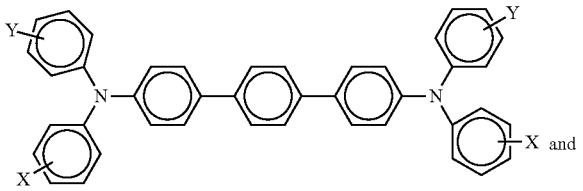

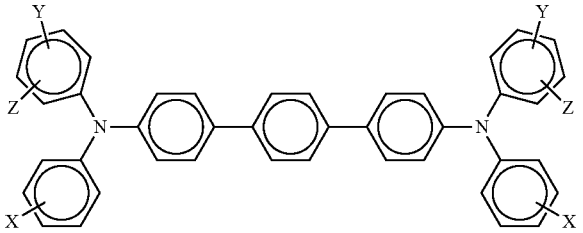

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Specific examples of hole transport layer components are represented by the following
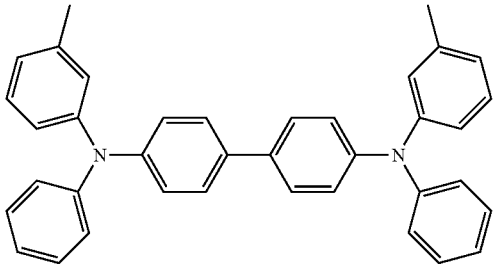
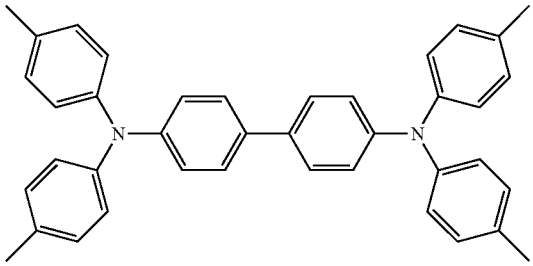
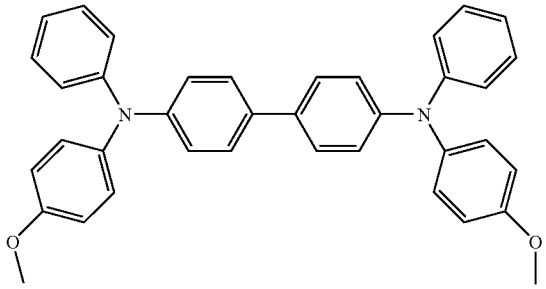
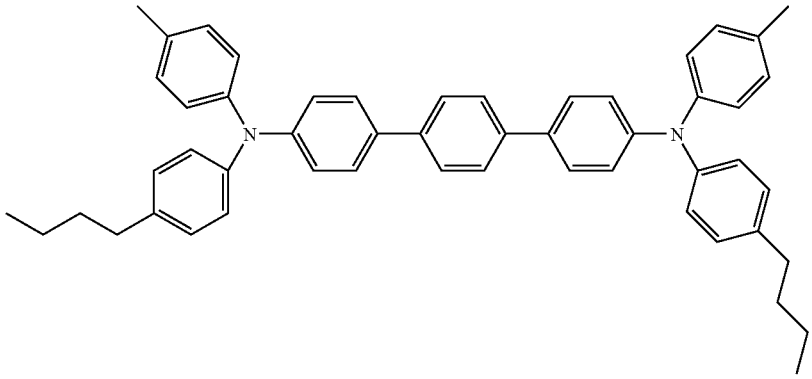
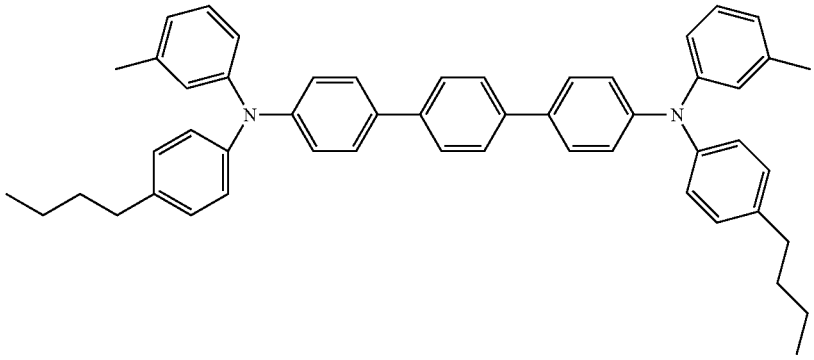
and
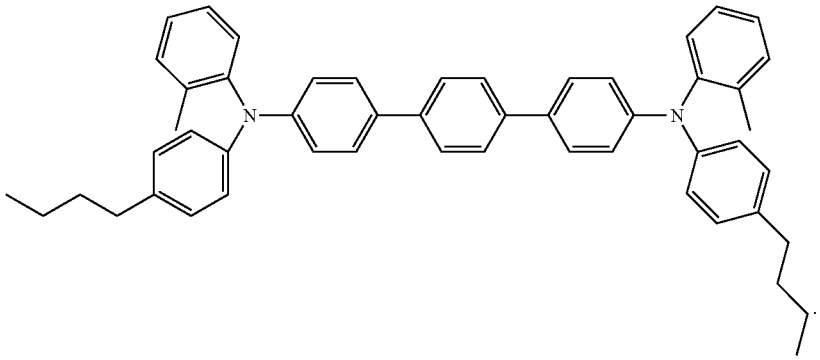

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine-diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present in the charge transport layer, or layers, for example, in an amount of from about 50 to about 75 weight percent include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes, for example, N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 5 to about 90 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The present disclosure in embodiments thereof relates to a photoconductive member comprised of a supporting substrate, a photogenerating layer, a light shock reducing additive containing charge transport layer, and an overcoating charge transport layer; a photoconductive member with a photogenerating layer of a thickness of from about 0.1 to about 10 microns, and at least one transport layer, each of a thickness of from about 50 to about 100 microns; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; a photoconductor wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, especially a first and second charge transport layer, comprises

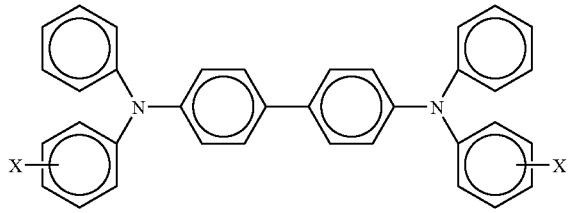

wherein X is selected from the group consisting of lower, that is with, for example, from 1 to about 8 carbon atoms, alkyl; alkoxy; aryl with, for example, 6 to about 36 carbon atoms, and halogen; a photoconductor wherein each of, or at least one of the charge transport layers comprises

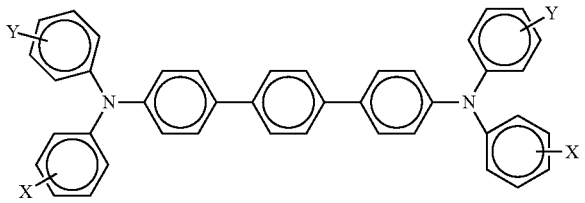

wherein X and Y are independently lower alkyl, lower alkoxy, phenyl, a halogen, or mixtures thereof, and wherein the photogenerating and charge transport layer resinous binder is selected from the group consisting of polycarbonates and polystyrene; a photoconductor wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, (CuK alpha radiation wavelength equals 0.1542 nanometers) at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on the photoconductor developing the latent image, and transferring the developed electrostatic image to a suitable substrate; a method of imaging wherein the imaging member is exposed to light of a wavelength of from about 370 to about 950 nanometers; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; a photoconductor wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductive imaging member comprised of a supporting substrate, a doped photogenerating layer, a hole transport layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer.

Examples of components or materials optionally incorporated into the charge transport layers, or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

In embodiments, there is disclosed a photoconductor comprising a supporting substrate, a photogenerating layer, and at least one hole transport layer; and wherein the photogenerating layer is comprised of a photogenerating pigment, and where the hole transport layer includes a pyrazine of the following structure/formula

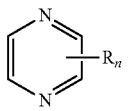

wherein n represents the number of R groups, such a number being, for example, from about 1 to about 4, and wherein R is independently at least one of hydrogen, alkyl, alkoxy, aryl, halo, mercapto, thio, amino, acetyl, cyano, furfurylthio, carboxyamide; and pyridyl; and a photoconductor wherein the pyrazine is present in an amount of from about 0.01 to about 25 weight percent; a photoconductor wherein the pyrazine is present in an amount of from about 0.005 to about 7, about 0.05 to about 3, and from about 0.01 to about 2 weight percent; and a photoconductor wherein the pyrazine is an alkyl pyrazine.

The following Examples are being submitted to illustrate embodiments of the present disclosure.

COMPARATIVE EXAMPLE 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

The photogenerating layer dispersion was prepared by introducing 0.45 gram of the known polycarbonate IUPILON 200™ (PCZ-200) weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V), and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. The photogenerating layer was dried at 120° C. for 1 minute in a forced air oven to form a dry photogenerating layer having a thickness of 0.4 micron.

(A) The photogenerating layer was then coated with a single charge transport layer prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

(B) In another embodiment, the resulting photogenerating layer was then coated with a dual charge transport layer. The first charge transport layer was prepared by introducing into an amber glass bottle in a weight ratio of 50/50, N,N'-bis (methylphenyl)-1,1-biphenyl-4,4'-diamine (TBD) and poly (4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 14.5 microns. During this coating process, the humidity was equal to or less than 30 percent, for example 25 percent.

The above first pass charge transport layer (CTL) was then overcoated with a second top charge transport layer in a second pass. The charge transport layer solution of the top layer was prepared as described above for the first bottom layer. This solution was applied, using a 2 mil Bird bar, on the bottom layer of the charge transport layer to form a coating that upon drying (120° C. for 1 minute) had a thickness of 14.5 microns. During this coating process, the humidity was equal to or less than 15 percent. The total two-layer CTL thickness was 29 microns.

(C) In another embodiment, a photoconductor was prepared with a single layer charge transport and in place of the methylene chloride solvent there was selected a carbon tetrachloride/methylene chloride mixture, 50 ppm/1 part methylene chloride.

(D) In yet another embodiment, a photoconductor was prepared with a single layer charge transport, and in place of the methylene chloride solvent there was selected a carbon tetrachloride/methylene chloride mixture, 100 ppm/1 part methylene chloride.

EXAMPLE I

A photoconductor was prepared by repeating the process of Comparative Example 1 (A) except that there was included in the single charge transport layer 100 parts per million (0.01 weight percent) of 2,3,5,6-tetramethylpyrazine, which pyrazine was added to and mixed with the prepared charge transport solution prior to the coating thereof on the photogenerating layer. More specifically, the aforementioned pyrazine additive was first dissolved in the charge transport layer solvent of methylene chloride, and then the resulting mixture was added to the charge transport layer components of the above aryl amine and resin binder. Thereafter, the mixture resulting was deposited on the photogenerating layer.

EXAMPLE II

A photoconductor was prepared by repeating the process of Comparative Example 1 (D) except that there was included in the charge transport layer 0.01 weight percent of 2,3,5,6-tetramethylpyrazine.

EXAMPLE III

A number of photoconductors are prepared by repeating the process of Comparative Example 1 (C) except that there is included in the charge transport layer 0.05 weight percent of pyrazine, (2-mercaptoethyl)pyrazine, 2,3,5-trimethylpyrazine, 2,3-dichloropyrazine, 2,3-dicyano-5-methylpyrazine, 2,3-diethyl-5-methylpyrazine, 2-(methylthio)pyrazine, 2-acetyl-3-ethylpyrazine, 2-amino-3,5-dibromopyrazine, 2-amino-5-phenylpyrazine, 2-furfurylthio-3-methylpyrazine, 5-methyl-2,3 cyclopentenopyrazine, pyrazinecarboxamide 2,3-di-2-pyridylpyrazine, 2,3-dimethylpyrido(2,3-b) pyrazine, or 6-methyl-7-phenyl-5H-pyrrolo[2,3-b]pyrazine.

EXAMPLE IV

A photoconductor was prepared by repeating the process of Comparative Example 1 (B) except that there was included in the first and in the second charge transport layers 0.01 weight percent of 2,3,5,6-tetramethylpyrazine, which additive was added to and mixed with the prepared charge transport solutions prior to the coating thereof on the photogenerating layer.

Electrical Property Testing

The above prepared photoconductors of Comparative Examples 1 (A), 1 (B), 1 (C), 1 (D), and Examples I, II, and IV were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.). The results are reported in Table 1.

In Table 1 V(3.5 ergs/cm$^2$) is the surface potential of the photoconductors when the exposure was 3.5 ergs/cm$^2$, $V_{erase}$ is the surface potential of the photoconductors after an erase lamp exposure, and these potentials can be used to characterize the photoconductors. There was substantially no change in the PIDC curves prior to light shock for the above seven photoconductors.

TABLE 1

| | V (3.5 ergs/cm$^2$) (V) | $V_{erase}$ (V) |
|---|---|---|
| Comparative Example 1 (A) Single-Layer Charge Transport Layer Coated From $CH_2Cl_2$ | 65 | 29 |
| Comparative Example 1 (B) Two-Layer Charge Transport Layer Coated From $CH_2Cl_2$ | 66 | 31 |
| Comparative Example 1 (C) Single-Layer Charge Transport Layer Coated From $CCl_4/CH_2Cl_2$ = 50 ppm/1 | 63 | 31 |
| Comparative Example 1 (D) Single-Layer Charge Transport Layer Coated From $CCl_4/CH_2Cl_2$ = 100 ppm/1 | 65 | 31 |
| Example I Single-Layer Charge Transport Layer With Pyrazine Coated From $CH_2Cl_2$ | 67 | 33 |

TABLE 1-continued

| | V (3.5 ergs/cm$^2$) (V) | $V_{erase}$ (V) |
|---|---|---|
| Example II Single-Layer Charge Transport Layer With Pyrazine Coated From $CCl_4/CH_2Cl_2$ = 100 ppm/1 | 64 | 29 |
| Example IV Two-Layer Charge Transport Layer With Pyrazine Coated From $CH_2Cl_2$ | 66 | 32 |

Light Shock Reduction

An in-house light shock test was performed for the above-prepared photoconductor devices (Comparative Examples 1 (A), 1 (C), 1 (D), and Example II). The top half of each of the above-prepared photoconductors was exposed under a fluorescent light (light energy about 324 μA) for about 37 minutes, and the PIDCs were generated and measured immediately after light exposure. As comparison, the bottom half of the photoconductors were shielded by black paper during the above light exposure, and the PIDCs of the bottom halves were also measured. The light shock results are summarized in Table 2 below.

TABLE 2

| | Light Shock % of $V_{bg}$ (3.5 ergs/cm$^2$) | Light Shock % of $V_{erase}$ |
|---|---|---|
| Comparative Example 1 (A) Single-Layer Charge Transport Layer Coated From $CH_2Cl_2$ | 1 | 1 |
| Comparative Example 1 (C) Single-Layer Charge Transport Layer Coated From $CCl_4/CH_2Cl_2$ = 50 ppm/1 | 5 | 4 |
| Comparative Example 1 (D) Single-Layer Charge Transport Layer Coated From $CCl_4/CH_2Cl_2$ = 100 ppm/1 | 9 | 16 |
| Example II Single-Layer Charge Transport Layer With Pyrazine Coated From $CCl_4/CH_2Cl_2$ = 100 ppm/1 | 3 | 3 |

In a number of instances when photoconductors are exposed to light, V(3.5 ergs/cm$^2$) and $V_{erase}$ are reduced immediately after exposure. For an ideal photoconductor, V(3.5 ergs/cm$^2$) and $V_{erase}$ should remain unchanged whether the photoconductor is exposed to light or not. Light shock percent of V(3.5 ergs/cm$^2$) is calculated by [V(3.5 ergs/cm$^2$)$_{unexposed}$−V(3.5 ergs/cm$^2$)$_{exposed}$]/V(3.5 ergs/cm$^2$)$_{unexposed}$, and the light shock percent of $V_{erase}$ is calculated as [Verase$_{unexposed}$−Verase$_{exposed}$]/Verase$_{unexposed}$. Thus, a light shock resistant photoconductor should have an acceptable value of light shock percent of V(3.5 ergs/cm$^2$) and an acceptable light shock percent of $V_{erase}$, which represents the reduction in V(3.5 ergs/cm$^2$) and $V_{erase}$ after light exposure is minimal.

As demonstrated in Table 2, the addition of ppm level of $CCl_4$ into the charge transport solution resulted in unacceptable light shock characteristics. With 100 ppm of $CCl_4$ in the solution, the light shock percent of $V_{erase}$ was 16 percent compared to almost no light shock (1 percent) when no $CCl_4$ contamination was present.

Incorporation of the pyrazine additive into the charge transport solution with 100 ppm of $CCl_4$ contamination (Example II) improved light shock resistance with a light shock percent of $V_{erase}$ of 3 percent, which was comparable to that of the photoconductor coated from the solvent without any $CCl_4$ contamination (1 percent, Comparative Example 1 (A)).

The ppm level of $CCl_4$ contamination sometimes is unavoidable in the coating solvent $CH_2Cl_2$, thus incorporation of the above pyrazine additive into the charge transport solution renders the photoconductors light shock resistant.

Light shock, such as with the photoconductors of the Comparative Examples 1 (C) and 1 (D), causes dark bands to form on xerographic prints when the photoconductors are exposed to light at t equals 0. The light shock resistant Example II photoconductor did not xerographically print dark bands even when the photoconductor was exposed to light.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport component, and a pyrazine, and wherein said charge transport component is comprised of at least one of

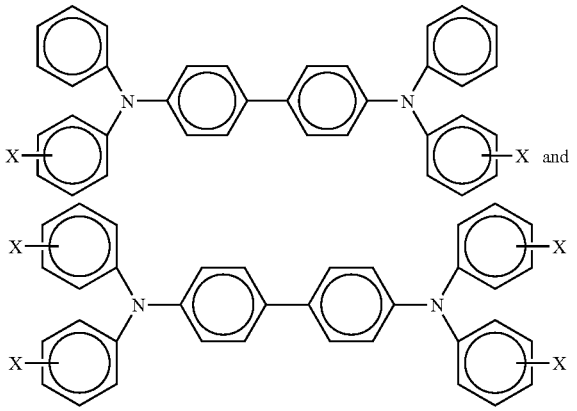

and wherein X is selected from the group consisting of at least one of alkyl, alkoxy, aryl, and halogen, said at least one charge transport layer consists of a first charge transport layer and a second charge transport layer, and wherein said pyrazine is present in an amount of 0.01 to 25 weight percent in each of said first charge transport layer and in said second charge transport layer, and wherein said first and said second charge transport layers include an antioxidant of a hindered phenolic present in an amount of from about 1 to about 10 weight percent.

2. A photoconductor in accordance with claim 1 wherein said pyrazine is present in an amount of from about 0.01 to about 2 weight percent.

3. A photoconductor in accordance with claim 1 wherein said pyrazine is present in an amount of from about 0.05 to about 5 weight percent.

4. A photoconductor in accordance with claim 1 wherein said pyrazine is represented by the following structure/formula

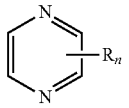

wherein n represents the number of R substituents, and which number is from 1 to 4,and R is at least one of hydrogen, alkyl, alkoxy, aryl, halo, mercapto, thio, amino, acetyl, cyano, furfurylthio, carboxyamide, and pyridyl.

5. A photoconductor in accordance with claim 4 wherein R is alkyl or alkoxy.

6. A photoconductor in accordance with claim 1 wherein said pyrazine is at least one of 2,3,5,6-tetramethylpyrazine, pyrazine, (2-mercaptoethyl)pyrazine, 2,3,5-trimethylpyrazine, 2,3-dichloropyrazine, 2,3-dicyano-5-methylpyrazine, 2,3-diethyl-5-methylpyrazine, 2-(methylthio)pyrazine, 2-acetyl-3-ethylpyrazine, 2-amino-3,5-dibromopyrazine, 2-amino-5-phenylpyrazine, 2-furfurylthio-3-methylpyrazine, 5-methyl-2,3-cyclopentenopyrazine, pyrazinecarboxamide, 2,3-di-2-pyridylpyrazine, 2,3-dimethylpyrido(2,3-b) pyrazine, and 6-methyl-7-phenyl-5H-pyrrolo[2,3-b] pyrazine.

7. A photoconductor in accordance with claim 1 wherein said pyrazine consists of at least one of 2,3,5,6-tetramethylpyrazine, and 2,3,5-trimethylpyrazine.

8. A photoconductor in accordance with claim 1 wherein said pyrazine is 2,3,5,6-tetramethylpyrazine present in an amount of from about 0.01 to about 2 weight percent.

9. A photoconductor in accordance with claim 1 wherein said pyrazine is an alkyl pyrazine.

10. A photoconductor in accordance with claim 1 wherein said pyrazine is at least one of 2,3,5,6-tetramethylpyrazine, pyrazine, (2-mercaptoethyl)pyrazine, 2,3,5-trimethylpyrazine, 2,3-dichloropyrazine, 2,3-dicyano-5-methylpyrazine, 2,3-diethyl-5-methylpyrazine, 2-(methylthio)pyrazine, 2-acetyl-3-ethylpyrazine, 2-amino-3,5-dibromopyrazine, 2-amino-5-phenylpyrazine, 2-furfurylthio-3-methylpyrazine, 5-methyl-2,3-cyclopentenopyrazine, pyrazinecarboxamide, 2,3-di-2-pyridylpyrazine, 2,3-dimethylpyrido(2,3-b) pyrazine, and 6-methyl-7-phenyl-5H-pyrrolo[2,3-b] pyrazine, and wherein said charge transport component is N,N'-diphenyl-N,N-bis(3-methylphenyl)-1,1'-biphenyl-4,4'-diamine.

11. A photoconductor in accordance with claim 1 wherein said photogenerating layer is comprised of at least one photogenerating pigment.

12. A photoconductor in accordance with claim 11 wherein said photogenerating pigment is comprised of at least one of a perylene, a metal phthalocyanine, and a metal free phthalocyanine.

13. A photoconductor in accordance with claim 11 wherein said photogenerating pigment is comprised of at least one of chlorogallium phthalocyanine, hydroxygallium phthalocyanine, and titanyl phthalocyanine.

14. A photoconductor in accordance with claim 1 further including a hole blocking layer, and an adhesive layer; and wherein said pyrazine is at least one of 2,3,5,6-tetramethylpyrazine, pyrazine, (2-mercaptoethyl)pyrazine, 2,3,5-trimethylpyrazine, 2,3-dichloropyrazine, 2,3-dicyano-5-methylpyrazine, 2,3-diethyl-5-methylpyrazine, 2-(methylthio) pyrazine, 2-acetyl-3-ethylpyrazine, 2-amino-3,5-dibromopyrazine, 2-amino-5-phenylpyrazine, 2-furfurylthio-3-methylpyrazine, 5-methyl-2,3-cyclopentenopyrazine, pyrazinecarboxamide, 2,3-di-2-pyridylpyrazine, 2,3-dimethylpyrido(2,3-b)pyrazine, and 6-methyl-7-phenyl-5H-pyrrolo[2,3-b]pyrazine.

15. A photoconductor in accordance with claim 1 wherein said second charge transport layer is in contact with said first charge transport layer and said first charge transport layer is in contact with said photogenerating layer; and wherein said first and said second charge transport layers contain N,N'-bis(methylphenyl)-1,1-biphenyl-4,4'-diamine, and wherein said pyrazine is represented by at least one of

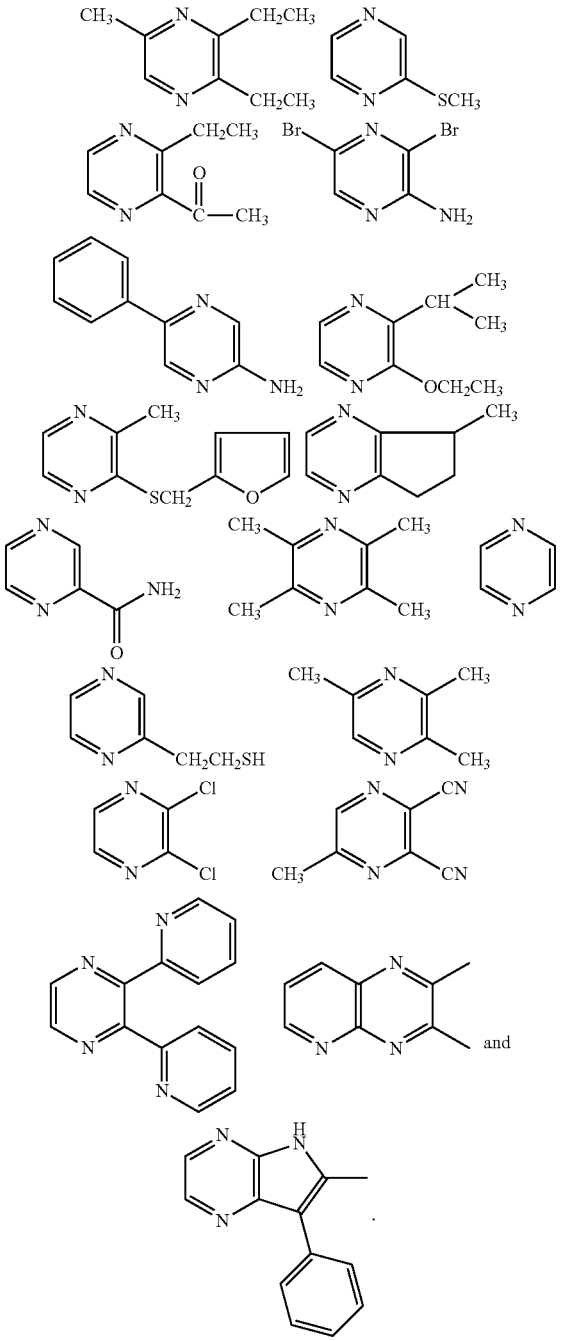

16. A photoconductor in accordance with claim 1 wherein said pyrazine is present in an amount of from about 0.007 to about 3 weight percent.

17. A photoconductor in accordance with claim 1 wherein said photogenerating layer is comprised of a photogenerating pigment and a resin binder; said pyrazine present in the first and second charge transport layers is 2,3,5,6-tetramethylpyrazine and wherein said pyrazine is present in an amount of from about 0.01 to about 3 weight percent.

18. A photoconductor in accordance with claim 1 wherein said pyrazine is selected from the group consisting of

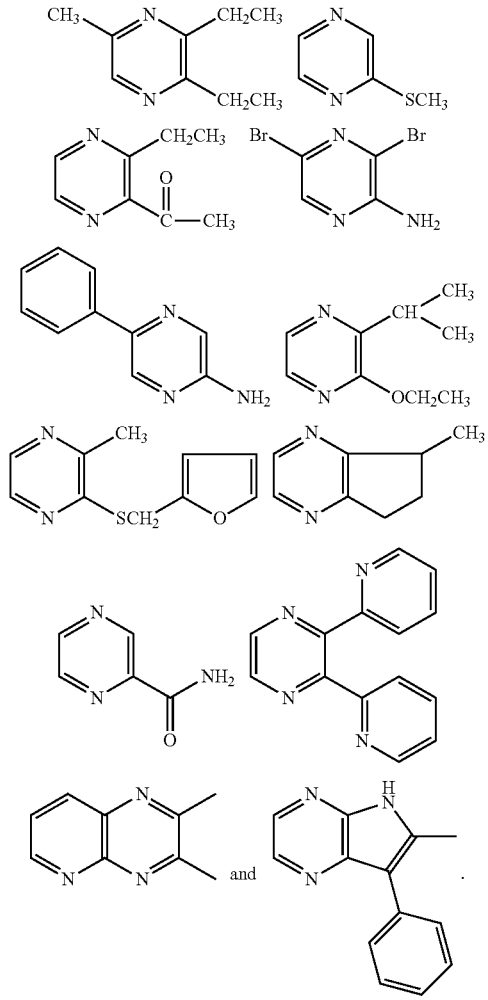

19. A photoconductor in accordance with claim 18 wherein said pyrazine is present in an amount of from about 0.01 to about 4 weight percent.

20. A photoconductor comprising a supporting substrate, a photogenerating layer, and at least one hole transport layer; and wherein said photogenerating layer is comprised of a photogenerating pigment, and where said hole transport layer includes a pyrazine of the following structure/formula

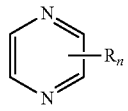

wherein n represents the number of R groups of from 1 to 4,and R is independently at least one of hydrogen, alkyl, alkoxy, aryl, halo, mercapto, thio, amino, acetyl, cyano, furfurylthio, carboxyamide, and pyridyl, and wherein said hole transport layer includes an aryl amine selected from the group consisting of those represented by the following formulas/structures

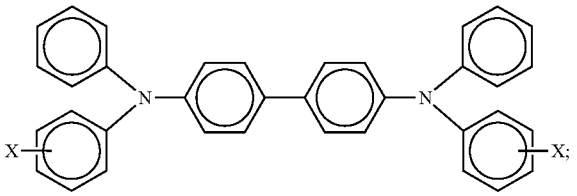

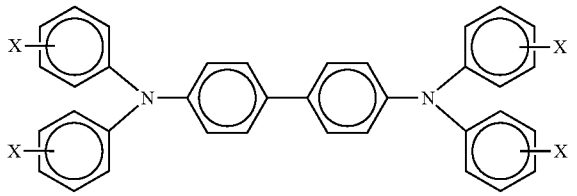

wherein X is selected from the group consisting of at least one of alkyl, alkoxy, aryl, and halogen; and

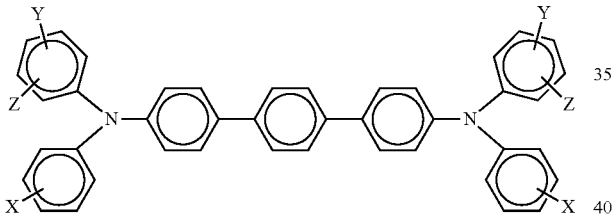

wherein X, Y and Z are independently selected from the group consisting of at least one of alkyl, alkoxy, aryl, and halogen; and wherein said pyrazine is present in an amount of 0.01 to 25 weight percent and wherein said at least one hole transport layer includes an antioxidant of a hindered phenolic present in an amount of from about 1 to about 10 weight percent.

21. A photoconductor in accordance with claim 20 wherein said hole transport layer aryl amine is comprised of

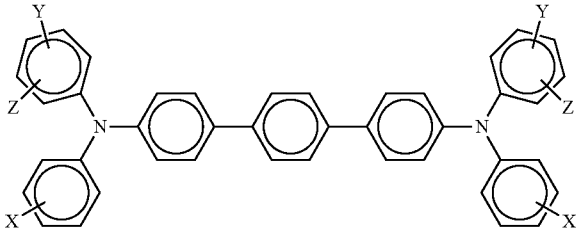

wherein X, Y and Z are independently selected from the group consisting of at least one of alkyl, alkoxy, aryl, and halogen.

22. A photoconductor in accordance with claim 21 wherein said hole transport layer aryl amine is selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof; and wherein said pyrazine is at least one of 2,3,5,6-tetramethylpyrazine, pyrazine, (2-mercaptoethyl)pyrazine, 2,3,5-trimethylpyrazine, 2,3-dichloropyrazine, and 2, 3-dicyano-5-methylpyrazine.

23. A photoconductor in accordance with claim 20 wherein said pyrazine is an alkyl pyrazine.

24. A photoconductor in accordance with claim 20 wherein said hole transport layer further contains a resin binder, said photogenerating layer is comprised of at least one photogenerating pigment and a resin binder, and wherein the photogenerating layer is situated between said substrate and said hole transport layer, and said R is independently methyl, ethyl, n-propyl, isopropyl, isobutyl, n-butyl, phenyl, methoxy, ethoxy, isopropoxy chloro, bromo, mercaptoethyl, methylthio, or mixtures thereof.

25. A photoconductor in accordance with claim 20 wherein said photogenerating layer contains a resin binder and a photogenerating pigment of a metal phthalocyanine or a metal free phthalocyanine, and said pyrazine is present in an amount of from about 0.006 to about 5 weight percent.

* * * * *